US005353768A

United States Patent [19]

Messih et al.

[11] Patent Number: 5,353,768

[45] Date of Patent: Oct. 11, 1994

[54] FUEL CONTROL SYSTEM WITH COMPENSATION FOR INTAKE VALVE AND ENGINE COOLANT TEMPERATURE WARM-UP RATES

[75] Inventors: Isis A. Messih, Troy; Charles F. Aquino, Ann Arbor, both of Mich.

[73] Assignee: Ford Motor Company, Dearborn, Mich.

[21] Appl. No.: 151,680

[22] Filed: Nov. 15, 1993

[51] Int. Cl.[5] ..... F02M 51/00

[52] U.S. Cl. ..... 123/491; 123/492; 123/493

[58] Field of Search ..... 123/491, 492, 493

[56] References Cited

U.S. PATENT DOCUMENTS

| | | | |
|---|---|---|---|
| 4,357,923 | 11/1982 | Hidig | 123/492 |
| 4,454,847 | 6/1984 | Isomura et al. | 123/492 |
| 4,543,973 | 10/1985 | Amano et al. | 123/492 |
| 4,922,877 | 5/1990 | Nagaishi | 123/492 |

*Primary Examiner*—Andrew M. Dolinar

*Attorney, Agent, or Firm*—Alan J. Lippa; Roger L. May

[57] ABSTRACT

An electronic engine controller (EEC) controls the delivery of fuel to an internal combustion engine via one or more fuel injectors by generating a base fuel value and modifying it with a transient fuel compensation value. The EEC determines the transient fuel compensation value by measuring a temperature value indicative of the temperature of the induction system of the engine and determining a valve effect value indicative of the effect of intake valve temperature on the vaporization of fuel in the induction system. A transient fuel compensation value is then generated in response to the temperature value and the valve effect value. The base fuel value, generated under any of a variety of known engine control methods, including open-loop control and closed-loop control, is altered in response to the transient fuel compensation value to generate a fuel injector control signal for controlling the amount of fuel delivered by the fuel injectors.

20 Claims, 4 Drawing Sheets

501
Enter From Fig. 2(a)

502
EFFLG1 = 0
and
TFCISW = 1
?
YES
503
EFFLG1 = 1
AISF = EISF
TFC_FUEL = 0
NO
504
EFFLG1 = 0
and
TFCISW = 0
?
YES
505
EFFLG1 = 1
AISF = 0
TFC_FUEL = 0
NO
506
DFSFLG = 1
?
YES
507
AISF = EISF * AISFM
TFC_FUEL = 0
NO
508
TFC_IDLE_OFF = 1
and
(REFFLG = 1) or (ISCFLG > 0)
or
ISCFLG = -1
and
N - DSDRPM < TFSMN
?
YES
509
AISF = EISF
TFC_FUEL = 0
NO
512
Go To Fig. 2(c)
511
TFC_TME_LST = CLOCK
513
Exit

FUEL CONTROL SYSTEM WITH COMPENSATION FOR INTAKE VALVE AND ENGINE COOLANT TEMPERATURE WARM-UP RATES

FIELD OF THE INVENTION

This invention relates to methods and apparatus for controlling the delivery of fuel to an internal combustion engine and more specifically, though in its broader aspects, not limited to, methods and apparatus for compensating for the induction system wetting effects caused by the difference in temperature warm-up rates between the intake valves and engine coolant in the engine.

BACKGROUND OF THE INVENTION

Fuel control systems are known which compensate for fuel delay caused by slow fuel vaporization during cold engine operation by utilizing a predetermined delay model which alters the amount of fuel injected according to engine temperature. As the engine warms up, different values are obtained from the delay model to reflect the increased fuel vaporization rate. Such models typically store information as a function of engine coolant temperature which correlates generally with the temperature of metal contacted by fuel as it is injected and hence correlates generally with fuel vaporization rate.

In practice, a portion of the injected fuel directly impacts the intake valve which, because it is less affected by the engine coolant temperature, warms up at a different rate than the walls of the induction system. Fuel directly impacting the intake valve vaporizes at a different rate than that predicted by the model. Consequently, model values based on engine coolant temperature lead to inaccurate quantities of fuel being delivered during engine warm-up, which leads to poor engine performance.

SUMMARY OF THE INVENTION

It is an object of the present invention to improve engine performance, and particularly during warm-up by controlling the amount of fuel delivered to the engine in a manner that is consistent with the vaporization rate of fuel during engine warm-up.

In accordance with the present invention the above object is achieved by measuring a temperature value indicative of the temperature of the induction system of the engine and determining a valve effect value indicative of the effect of intake valve temperature on the vaporization of fuel in the induction system. A transient fuel compensation value is then generated in response to the temperature value and the valve effect value. A fuel injector signal, generated under any of a variety of known engine control methods, including open-loop control and closed-loop control, is altered in response to the transient fuel compensation value.

An advantage of at least certain preferred embodiments is that the quantity of fuel injected is determined as a function of vaporization rate of fuel directly impacting the intake valve as well as the vaporization rate of fuel impacting the walls of the induction system. Consequently, greater precision in the delivery of fuel to the engine is achieved and engine performance during warm-up is enhanced.

These and other features and advantages of the present invention may be better understood by considering the following detailed description of a preferred embodiment of the invention. In the course of this description, reference will be made to the attached drawings.

DETAILED DESCRIPTION

Figure 1:
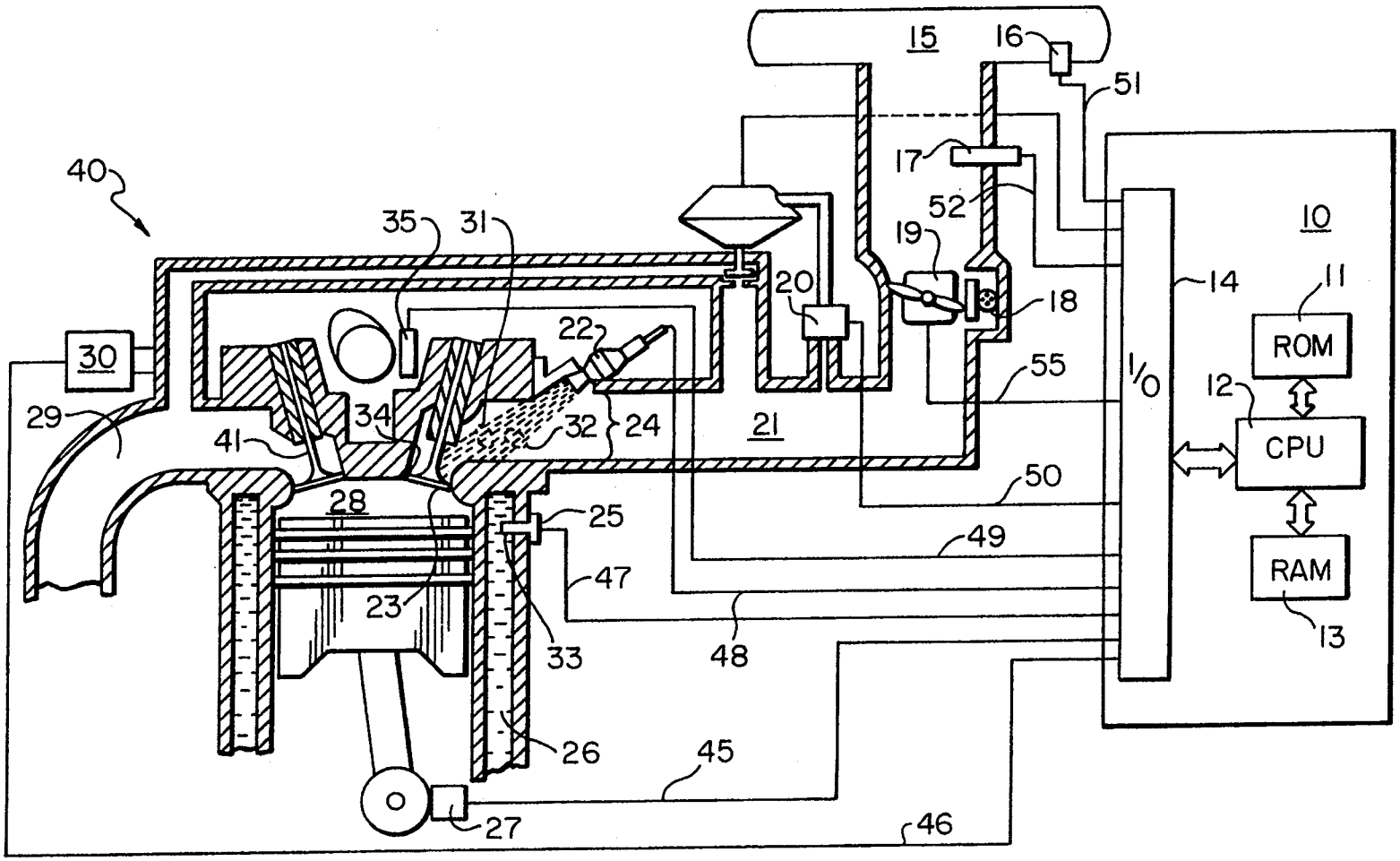
FIG. 1 is a schematic, partially cross-sectional illustration of an internal combustion engine and an electronic engine controller which embody the principles of the invention.

In FIG. 1 an internal combustion engine 40 comprising a plurality of cylinders, one cylinder of which is shown in FIG. 1, is controlled by an electronic engine controller (EEC) 10 which receives a plurality of signals from the engine, including an engine coolant temperature (ECT) signal 47 from an engine coolant temperature sensor 25 which is exposed to engine coolant circulating through coolant sleeve 26, a cylinder identification (CID) signal 49 from a CID sensor 35, a throttle position signal 55 generated by a throttle position sensor 19, a profile ignition pickup (PIP) signal 45 generated by a PIP sensor 27, a heated exhaust gas oxygen (HEGO) signal 46 from a HEGO sensor 30, an air intake temperature signal 51 from an air temperature sensor 16, and an air flow signal 52 from an air flow meter 17. The EEC 10 processes these signals received from the engine and generates a fuel injector signal transmitted to fuel injector 22 on signal line 48 to control the amount of fuel delivered by fuel injector 22. Intake valve 23 operates to open and close intake port 34 to control the entry of an air/fuel mixture into combustion chamber 28..

Engine coolant circulating through coolant sleeve 26 operates to dissipate heat generated from the ignition of the air/fuel mixture in combustion chamber 28. Air drawn through air intake 15 passes by air temperature sensor 16, air flow meter 17 which senses the mass flow rate of air, throttle position sensor 19 and into induction system 21 which includes an intake port 34. A portion of the fuel from fuel injector 22, seen at 32, directly impacts the walls 24 of the induction system 21, the temperature of which is a function of the engine coolant temperature as sensed by coolant temperature sensor 25 and transmitted to the EEC 10 via signal line 47. Another portion of the fuel injected by injector 22, seen at 31, directly impacts the intake valve 23, which is less affected by the temperature of the engine coolant than are the walls 24 of the induction system. Some of the fuel which directly impacts the walls 24 then is drawn into combustion chamber 28, while the remainder is left on the walls 24 as a residue.

A preferred embodiment of the present invention advantageously controls the delivery of fuel to the intake port in a manner which compensates for the difference in warm-up rates between the intake valve and the walls of the induction system proximate to the intake port by generating a base fuel value according to any of a variety of known methods, including open-loop and closed-loop control methods, determining a value corresponding to the rate of change of fuel film mass on the walls of the induction system, and altering the base fuel value in accordance with the value corresponding to the rate of change of fuel film mass on the walls of the induction system. The rate of change of fuel film mass on the walls of the induction system is advantageously calculated by measuring the engine coolant temperature which is indicative of the temperature of the walls of the induction system, determining a valve effect value which is indicative of the effect of intake valve temperature on the vaporization of fuel injected into the induction system and generating a transient fuel compensation value as a function of both the engine coolant temperature and the valve effect value. The fuel injector signal 48 is thus comprised of a base fuel value, calculated by known methods under an open or closed loop method of control and a transient fuel compensation value which is added to the base fuel value and is generated in a manner to be described.

Figure 2A:
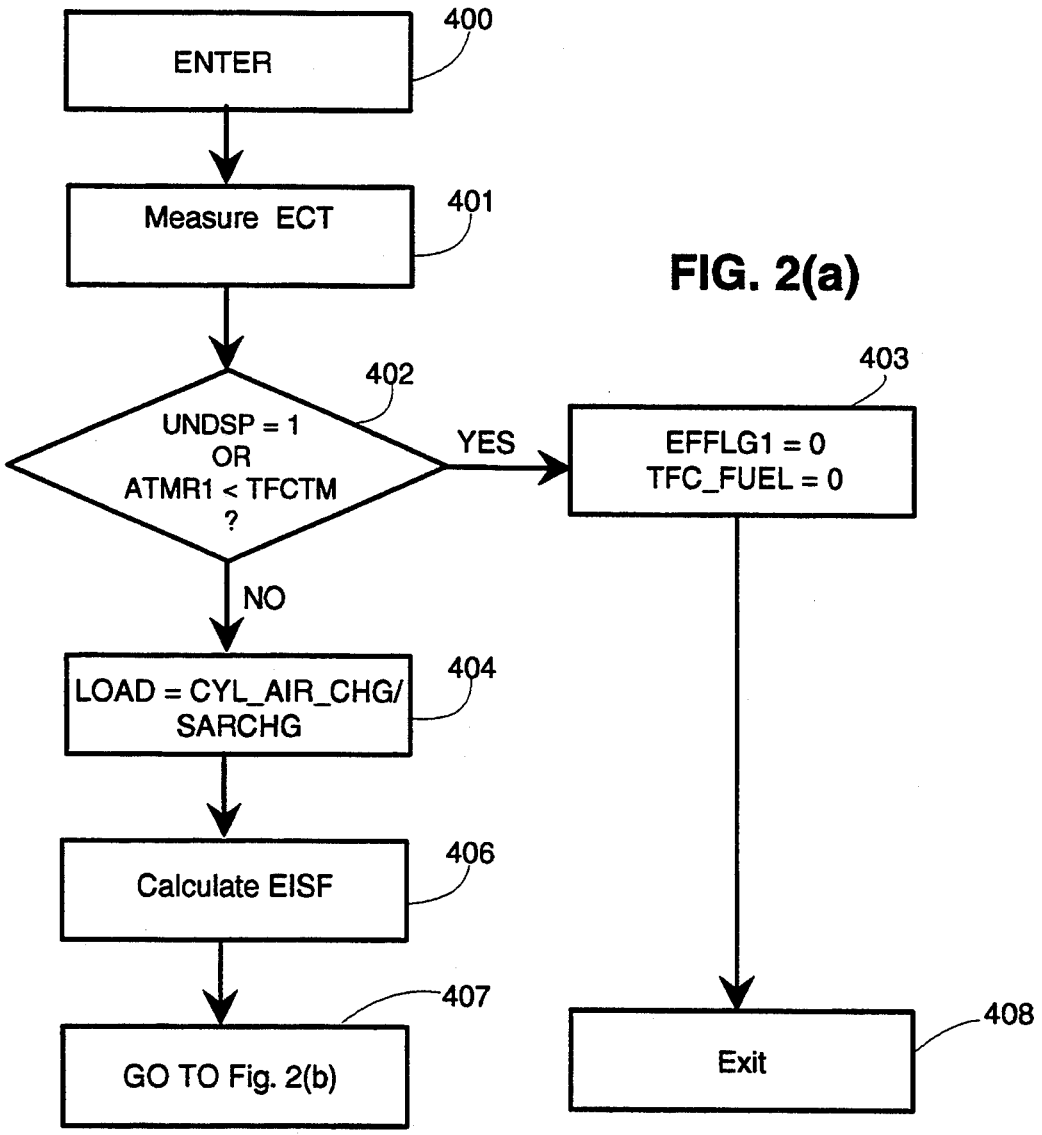
FIGS. 2(*a*), 2(*b*) and 2(*c*) are flowcharts showing the operation of a preferred embodiment of the invention.
Figure 2B:
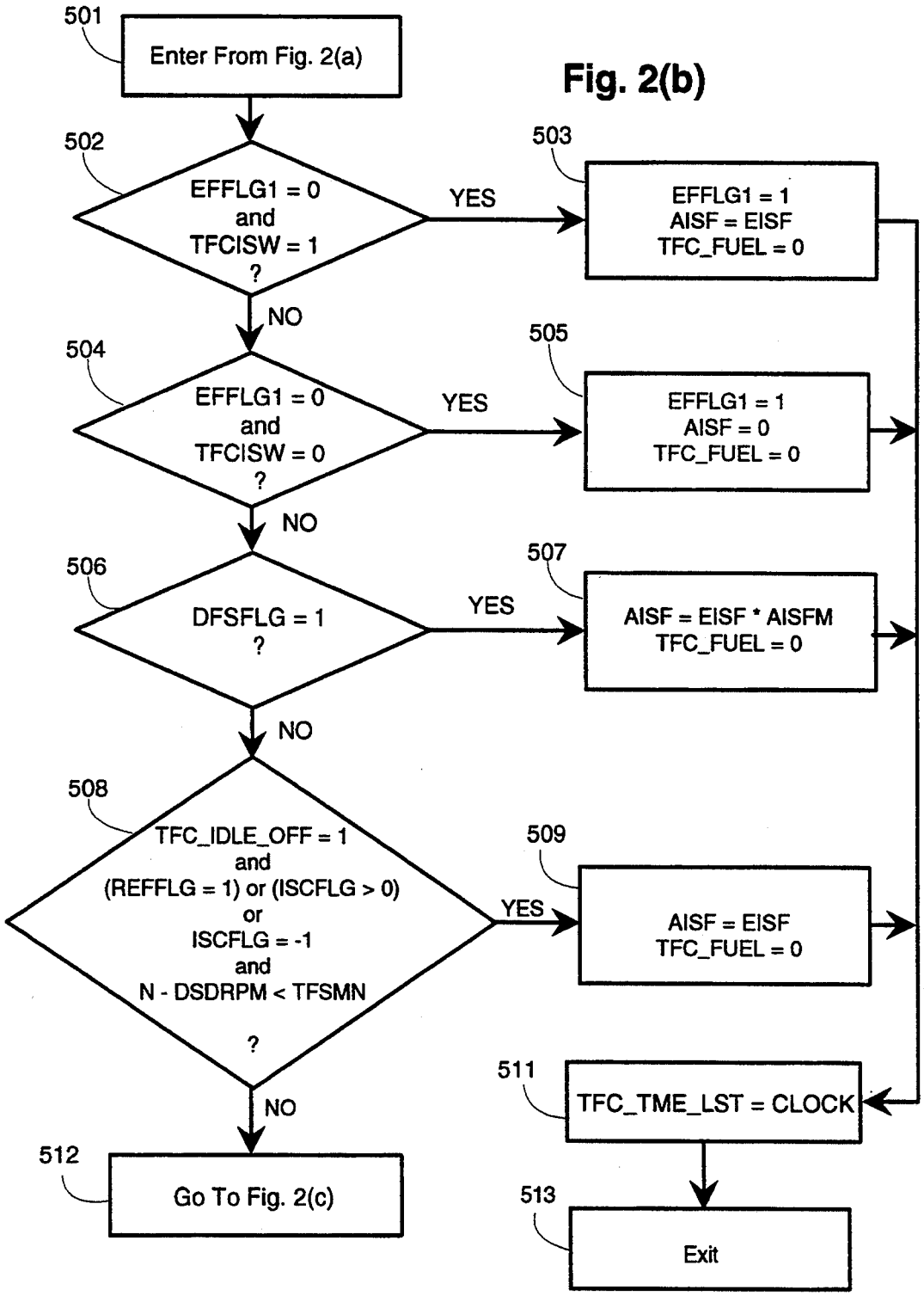
Figure 2C:
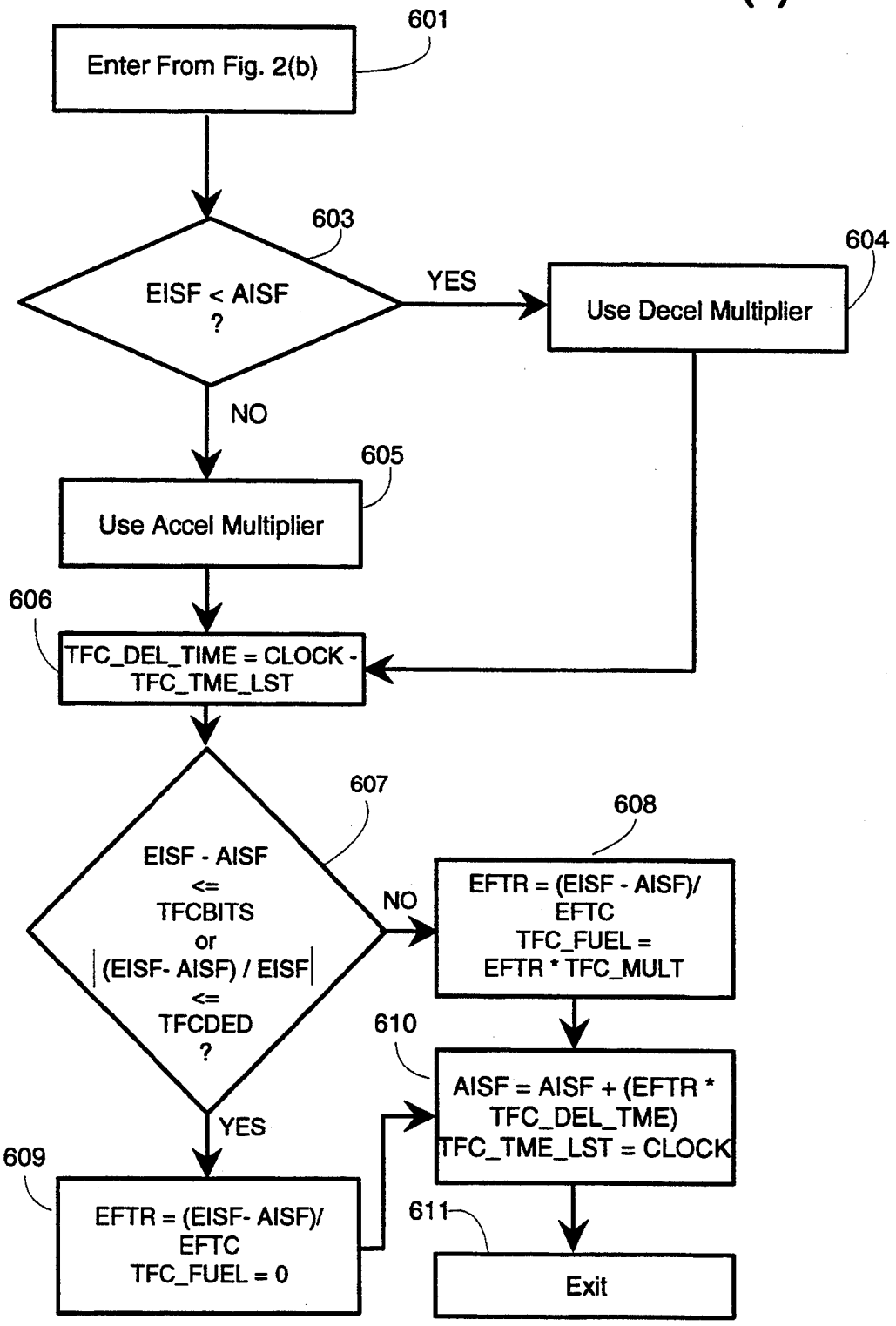

FIGS. 2(*a*) – 2(*c*) show a transient fuel compensation routine comprising a series of steps performed by the preferred embodiment to calculate the transient fuel compensation value. The steps shown in FIGS. 2(*a*) – 2(*c*) comprise a portion of a background loop which is executed continuously by the EEC 10. At 401 the signal 47 transmitted by the engine coolant temperature sensor 25 is read and stored in an engine coolant temperature variable ECT. At 402 two threshold comparisons are made to determine if the engine is operating in a proper mode for transient fuel compensation, and if an adequate amount of time from engine crank has elapsed for transient fuel compensation to begin. The first determination is made by testing a flag, UNDSP which is set to the value one by the EEC 10 if the engine is in an underspeed or crank mode. If UNDSP = 0 then the engine is in neither underspeed or crank mode and transient fuel compensation may be performed, so long as an adequate amount of time has elapsed from exiting crank mode. The preferred embodiment advantageously allows a predetermined period of time, represented by a value TFCTM stored in ROM 11, to elapse after exiting crank mode in order to allow various aspects of engine operation to adequately stabilize such that accurate measurements of engine operating parameters may be made. This determination is made by comparing a value ATMR1, which corresponds to time elapsed since exiting crank mode, to the value TFCTM and performing transient fuel compensation if ATMR1 is greater than or equal to TFCTM. If transient fuel compensation is not to be performed, then the value EFFLG1 is set to zero. EFFLG1 is an equilibrium fuel flag which controls the setting of an initial value of an actual fuel mass value AISF, which represents the actual fuel film mass residing on the walls 24 of the induction system 21 when the engine is operating under transient conditions. TFC_FUEL, the transient fuel compensation value, which indicates the fuel mass per injection from transient fuel compensation, is also set to zero and the routine is exited at 408.

If EEC 10 at step 402 determines that transient fuel compensation is to be performed, then at 404 a load value, LOAD is calculated by the following relationship:

$$\text{LOAD} = \text{CYL_AIR_CHG}/\text{SARCHG} \quad (1)$$

where

SARCHG represents a standard air charge value at standard temperature and pressure obtained by dividing the engine displacement (in cubic inches) by the number of cylinders, and CYL_AIR_CHG is a value indicative of engine load and is calculated by EEC 10 as a function of mass air flow into the induction system as measured by air flow meter 17 and engine angular speed as indicated by PIP signal 45.

At 406 an equilibrium fuel mass value EISF, which is indicative of the fuel mass residing on the walls of the induction system when the engine is operating under substantially steady state operation, is calculated according to the following relationship:

$$\text{EISF} = \text{FN1321(ECT, LOAD)}*\text{FN313(N)}*\text{MTEISF} \quad (2)$$

where:

FN1321(ECT, LOAD) is a value obtained from a table contained in the ROM 11 in which are stored predetermined values indexed by the variables ECT representative of engine coolant temperature, and LOAD representative of engine load;

FN313(N) is a value representative of an equilibrium intake surface fuel multiplier at a particular engine speed, N; and MTEISF is a predetermined multiplicative constant.

As indicated at 407 and 501, FIG. 2(*b*) shows the steps performed by the preferred embodiment after step 406 in FIG. 2(*a*). The preferred embodiment advantageously checks certain flags and variables at steps 502, 504, 506 and 508 in order to determine the operating mode of the engine and hence the amount of transient fuel control required. Steps 502, 504, 506 and 508 each contain certain flags and variables, the value of which determine an initial value for the actual fuel mass value AISF.

Upon an initial pass of the transient fuel compensation routine, EFFLG1 will be equal to zero, and TFCISW will be set to one or zero based upon an empirical determination of an amount of fuel required to establish a film mass on the walls of the induction system just after engine crank. Upon the first pass, if at block 502 TFCISW = 1, then at 503 the actual fuel mass value AISF is set equal to the equilibrium fuel mass value EISF and the transient fuel compensation value TFC_FUEL is set to zero, meaning that the fuel injector signal is not altered by the transient fuel compensation value TFC_FUEL.

At 504 upon the initial pass, EFFLG1 will equal zero, as stated above. If TFCISW also equals zero, then at 505 AISF is set to zero, EFFLG1 is set to one and TFC_FUEL is set to zero, as in step 503. The routine is then exited at 513. If at step 502 upon the initial pass TFCISW does not equal one then the routine proceeds to step 504.

At 506, a deceleration fuel shutoff flag DFSFLG is checked. If DFSFLG = 1, indicating that the engine is in a deceleration fuel shutoff condition, then at 507 the actual fuel mass value AISF is calculated by multiplying the equilibrium fuel mass value EISF times a predetermined multiplier AISFM which is indicative of the fuel mass on the walls of the induction system during the deceleration fuel shutoff condition. The value TFC_FUEL is set to zero and the routine is exited at 513.

If DFSFLG is not equal to one, then at 508 a series of conditions are checked to further determine the mode in which the engine is operating. TFC_IDLE_OFF is a calibration switch which disables the use of transient fuel control during engine idle. REFFLG is a flag which, when having a value of one, indicates that the engine is in an idle fuel modulation mode. ISCFLG is an idle speed control flag which indicates whether the engine is in an idle speed control mode. Idle speed control mode is an engine operating mode which actively controls engine idle speed. ISCFLG will contain a value of one or two when the engine is in one of two closed-loop rpm control modes, a value of zero or minus one when the engine is in one of two dashpot control modes. The variable N indicates engine angular speed in revolutions per minute (RPM), DSDRPM is a variable representing a desired RPM value at engine idle and TFSMN is a constant representing an RPM value above idle, below which transient fuel control is disabled. If the conditions checked at 508 result in step 509 being executed, then the actual fuel mass value AISF is set equal to the equilibrium fuel mass value EISF, meaning that the engine is essentially operating under steady state conditions, TFC_FUEL is set to zero, thus disabling transient fuel compensation, and the routine is exited at 513, after setting the variable TFC_TME_LST is set equal to a value indicated by a real time clock represented by a variable CLOCK as seen at 511.

As indicated at 512 and 601, FIG. 2(*c*) shows the steps performed by the preferred embodiment after step 508 in FIG. 2(*b*). At 603, the equilibrium fuel mass value EISF is compared to the actual fuel mass value AISF to determine if the engine is under an acceleration or deceleration condition. The preferred embodiment of the present invention advantageously contains two tables, each stored in ROM 11 and indexed by a value indicative of the time elapsed since engine crank and by a value indicative of engine coolant temperature. The tables contain a plurality of valve effect values which are empirically derived and are representative of the effect of intake valve temperature on the vaporization of fuel in the induction system of the engine. One table contains valve effect values which are used if the engine is detected to be in an acceleration condition and the other table contains valve effect values which are used if the engine is detected to be in a deceleration condition. By storing different valve effect values for acceleration and deceleration conditions, the preferred embodiment allows different transient compensation values to be generated. Consequently, when the engine is under an acceleration condition, the transient fuel compensation value TFC_FUEL is generated in a manner which provides for enhanced power, and when the engine is under a deceleration condition, the transient fuel compensation value is generated in a manner which provides for enhanced air/fuel control and consequently reduced emissions.

If the engine is under an acceleration condition then at 605: (a) several acceleration multipliers will be used to calculate an equilibrium fuel time constant EFTC which is representative of a rate of change of the fuel mass on the walls of the induction system while the engine is under acceleration, and (b) a value TFC_MULT is calculated, which is a transient fuel multiplier value indicative of the effect of intake valve temperature on the vaporization rate when the engine is under acceleration, according to the following relationships:

$$EFTC = FN1322A(ECT,LOAD) * MTEFTC \quad (3)$$

$$ti\ TFC\ MULT = FN1323A(ECT,ATMR1) * STCF * DT22S \quad (4)$$

where:

FN1322A(ECT, LOAD) is a unitless value obtained from a table, indexed by engine coolant temperature ECT and engine load LOAD, and stored in the ROM 11 which contains predetermined values representative of a transient fuel time constant for an engine under acceleration;

MTEFTC is a predetermined equilibrium fuel time constant multiplier;

FN1323A(ECT, ATMR1) is a unitless valve effect value obtained from a table, indexed by engine coolant temperature and time since engine crank, and stored in ROM 1 I which contains a plurality of values representative of the effect of the changing intake valve temperature during engine warm-up on the vaporization of fuel in the induction system when the engine is under acceleration;

STCF is a conversion factor for convening time measured in seconds to time units as recognized by CPU 12; and DT12S is a variable representative of the time elapsed between adjacent rising edges of the PIP signal transmitted by the PIP sensor via signal line 45.

If at 603, the engine is determined to be under a deceleration condition then at 604, several deceleration multipliers will be used to calculate values for the variables EFTC and TFC_MULT according to the following relationships:

$$EFTC = FN1322D(ECT, LOAD) * MTEFTC \quad (5)$$

$$TFC_MULT = FNI323D(ECT, ATMR1) * STCF * DT12S \quad (6)$$

where:

EFTC is an equilibrium fuel time constant representative of a rate of change of the fuel mass on the walls of the induction system while the engine is under deceleration;

FN1322D(ECT, LOAD) is a value obtained from a table, indexed by engine coolant temperature ECT and engine load LOAD, and stored in the ROM 11 which contains predetermined values representative of a transient fuel time constant for an engine under deceleration;

MTEFTC is as explained above;

TFC_MULT is a transient fuel multiplier value indicative of the effect of intake valve temperature on the vaporization rate when the engine is under deceleration;

FN1323D(ECT, ATMR1) is a valve effect value obtained from a table, indexed by engine coolant temperature and time since engine crank, and stored in ROM 11 which contains a plurality of values representative of the effect of the changing intake valve temperature during engine warm-up on the vaporization of fuel in the induction system when the engine is under deceleration; and STCF and DT12S are as explained above.

At 606, an elapsed time value TFC_DEL_TME is calculated by subtracting the value indicative of the last time the value AISF was updated, TFC_TME_LST, from a real time value CLOCK, as generated by a real time clock contained in EEC 10. At 607 two comparisons are made to determine whether the difference between the equilibrium fuel mass value EISF and the actual fuel mass value AISF is sufficient to require transient fuel compensation. The preferred embodiment of the present invention advantageously utilizes a deadband value, represented in FIG. 2(*e*) at 607 by the values TFCBITS and TFCDED, which represent respectively, a fixed value and a percentage value, against which the value EISF minus AISF is compared. TFCBITS prevents transient fuel compensation if the difference between the equilibrium fuel mass and actual fuel mass is sufficiently small as to be attributable to inadequate resolution in the EEC 10 in the calculation of the EISF or AISF. In the case of TFCDED, which represents a percentage difference between the equilibrium or steady state fuel value and the transient fuel value, the percentage difference between EISF and AISF is determined and compared.

If the difference between the equilibrium fuel mass value and the actual fuel mass value is of a sufficient value, then an equilibrium transfer rate value EFTR, representative of an equilibrium transfer rate of fuel from the walls of the induction system to the combustion chamber, is calculated according to the following relationship:

$$EFTR = (EISF - AISF) / EFTC \quad (7)$$

where

EFTC, EISF and AISF are as explained above.

If the conditions checked at 607 result in step 608, then the transient fuel compensation value TFC_FUEL, which represents the fuel mass per injection from transient fuel compensation in lbs/cylinder, is calculated by multiplying EFTR times TFC_MULT. If either of the comparisons performed at 607 are true, then at 609 EFTR is calculated as above and TFC_FUEL is set to zero. At 610 the value AISF is calculated for use in steps 607 and 608 upon subsequent execution of the transient fuel control routine, and the routine is exited at 611. AISF is incrementally altered at 610 by adding EFTR multiplied by TFC_DEL_TME. The value TFC_TME_LST is then set equal to the current time value CLOCK contained in the real-time clock. As discussed above, the value TFC_FUEL is used by the EEC 10 in calculating the value for the fuel injector signal transmitted via signal line 48. Specifically, TFC_FUEL is added to a base fuel value which is generated by the EEC 10 by one of a variety of known methods of fuel control.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. In an internal combustion engine including an induction system comprised of an intake port, an intake valve for opening and closing the intake port and injector means for delivering fuel to a combustion chamber of the engine in an amount controlled by a fuel injector signal generated by an engine control means, a method for controlling delivery of fuel to the intake port, comprising the steps of:

measuring a temperature value indicative of the temperature of the induction system;

determining a valve effect value indicative of the effect of intake valve temperature on the vaporization of fuel in the induction system;

generating a transient fuel compensation value in response to the temperature value and the valve effect value; and generating the fuel injector signal in response to the transient fuel compensation value.

2. The method as set forth in claim 1 wherein the valve effect value is determined as a function of the temperature value and of time elapsed since exiting a crank mode.

3. The method as set forth in claim 2 wherein the step of generating the transient fuel compensation value in response to the temperature value and the valve effect value comprises the steps of:

calculating an equilibrium fuel mass value indicative of the fuel film mass on the walls of the induction system during steady state engine operation;

calculating an actual fuel mass value indicative of the fuel film mass on the walls of the induction system during transient engine operation;

calculating an equilibrium fuel time constant indicative of the rate of change of fuel film mass on the walls of the induction system;

comparing the equilibrium fuel mass value to the actual fuel mass value; and generating the transient fuel compensation value if the equilibrium fuel mass value and the actual fuel mass value differ by more than a predetermined amount.

4. The method as set forth in claim 3 wherein the temperature value is measured by measuring an engine coolant temperature.

5. The method as set forth in claim 4 wherein the valve effect value is estimated by measuring the time elapsed from engine crank, measuring the engine coolant temperature, generating an index value from the measured time and engine coolant temperature, and retrieving a value indicative of the effect of intake valve temperature on the vaporization rate of fuel in the induction system from a first table containing a plurality of values indexed by engine coolant temperature and time elapsed from engine crank if the engine is under an acceleration condition and retrieving a value indicative of the effect of intake valve temperature on the vaporization rate of fuel in the induction system from a second table containing a plurality of values indexed by engine coolant temperature and time elapsed from engine crank if the engine is under a deceleration condition.

6. The method as set forth in claim 5 wherein the step of calculating the equilibrium fuel time constant comprises the steps of:

measuring the mass of air flowing into the induction system;

measuring the angular speed of the engine;

generating a load value, indicative of engine load, as a function of the mass of air flowing into the induction system and the angular speed of the engine;

determining whether the engine is operating under an acceleration or deceleration condition;

retrieving a first value in response to the load value and the temperature value if the engine is operating under the acceleration condition;

retrieving a second value in response to the load value and the temperature value if the engine is operating under the deceleration condition; and calculating the equilibrium fuel time constant as a function of the first or the second retrieved value.

7. The method as set forth in claim 6 wherein the first value is retrieved from a first table containing a plurality of values indexed by the first measured temperature and load value and wherein the second value is retrieved from a second table containing a plurality of values indexed by the first measured temperature and load value.

8. The method as set forth in claim 7 wherein the step of calculating an equilibrium fuel mass value comprises the step of retrieving the equilibrium fuel mass value from a table containing a plurality of equilibrium fuel mass values indexed by engine coolant temperature and engine load.

9. The method as set forth in claim 8 further comprising the step of generating an equilibrium transfer rate value, indicative of a rate of transfer of fuel from the induction system to an associated combustion chamber of the engine, by determining the difference between the equilibrium fuel mass value and an actual fuel mass value and dividing the difference by the equilibrium fuel time constant.

10. The method as set forth in claim 9 wherein the actual fuel mass value is calculated by the steps generating an initial actual fuel mass value; and subsequently altering the initial actual fuel mass value as a function of the time elapsed since the initial generation of the actual fuel mass value and as a function of the equilibrium transfer rate value.

11. In an internal combustion engine including an induction system comprised of an intake port and an intake valve, a method for controlling the delivery of fuel to the intake port, comprising the steps of:

generating a base fuel value;

measuring an engine coolant temperature;

measuring time elapsed from engine crank;

determining the rate of change of fuel film mass on the walls of the induction system as a function of the time elapsed from engine crank and the engine coolant temperature to generate a compensation value indicative of the varying rate of change of fuel film mass on the walls of the induction system; and altering the base fuel value in accordance with the compensation value.

12. The method as set forth in claim 11 wherein the step of altering the base fuel value comprises the step of adding the compensation value to the base fuel value.

13. The method as set forth in claim 12 wherein the step of determining the rate of change of fuel film mass on the walls of the induction system comprises the steps of:

determining if the engine is operating in a transient state, and if so then determining if the engine is operating in an acceleration or deceleration state;

generating the compensation value by utilizing a predetermined set of acceleration conditions if the engine is operating in an acceleration state; and generating the compensation value by utilizing a predetermined set of deceleration conditions if the engine is operating in a deceleration state.

14. The method as set forth in claim 13 wherein the steps of generating the compensation value by utilizing a predetermined set of acceleration conditions if the engine is operating in an acceleration state and generating the compensation value by utilizing a predetermined set of deceleration conditions if the engine is operating in a deceleration state each comprise the steps of:

measuring the time elapsed since engine crank;

measuring the angular speed of the engine;

measuring an engine coolant temperature;

determining an equilibrium fuel mass value indicative of the fuel mass residing on the walls of the induction system during steady state engine operation;

determining an actual fuel mass value indicative of the fuel mass residing on the walls of the induction system during transient engine operation; and generating the compensation value as a function of the equilibrium fuel mass value, the actual fuel mass value the time elapsed since engine crank, the angular speed and the engine coolant temperature.

15. The method as set forth in claim 14 wherein the step of determining the equilibrium film mass value comprises the steps of:

measuring the mass flow rate of air into the engine to generate a load value indicative of engine load; and determining the equilibrium fuel mass value as a function of the engine coolant temperature, the load value and the angular speed of the engine.

16. The method as set forth in claim 15 wherein the step of determining the actual fuel mass comprises the steps of:

generating an initial actual fuel mass value;

determining a fuel mass rate of change value; and determining the actual fuel mass as a function of the initial actual fuel mass value and the fuel mass rate of change.

17. In combination, an internal combustion engine comprising an induction system which comprises one or more intake ports, each of the ports having associated therewith, at least one intake valve, means for injecting a quantity of fuel into each of the intake ports, means, responsive to the air flow into the manifold for generating a load value indicative of the load of the engine, means, responsive to the angular speed of the engine, for generating an rpm value indicative of the angular speed of the engine, means for measuring a temperature value indicative of the temperature of the induction system, means for determining a valve effect value indicative of the effect of intake valve temperature on the vaporization of fuel in the induction system, and means, responsive to the temperature value and to the valve effect value, for determining the quantity of fuel, comprising in combination, means, responsive to first temperature value and to the load value, for determining an equilibrium fuel mass value indicative of the fuel mass residing within the induction system during steady state operation of the engine at the temperature and load value, and means, responsive to the equilibrium fuel mass value, for determining an actual fuel mass value indicative of the fuel mass residing within the induction system during transient operation of the engine at the temperature and load value.

18. The invention as set forth in claim 17 wherein the means for means for determining a valve effect value comprises, means for measuring the time elapsed from engine crank, means, responsive to the time elapsed from engine crank and to the temperature value, for generating an index value, and means, responsive to the index value, for retrieving the valve effect value from a table.

19. The invention as set forth in claim 18 wherein the means for retrieving the valve effect value from a table comprises, first means, responsive to the equilibrium fuel mass value and to the actual fuel mass value, for determining whether the engine is in an acceleration or deceleration condition, second means, responsive to the first means, for retrieving a first predetermined value, if the engine is in an acceleration condition, and third means, responsive to the first means, for retrieving a second predetermined value, if the engine is in a deceleration condition.

20. The invention as set forth in claim 19 wherein the first and second predetermined values are each stored in a non-volatile memory.

* * * * *